US005675908A

United States Patent [19]

Barnes

[11] Patent Number: 5,675,908

[45] Date of Patent: Oct. 14, 1997

[54] CLOTHES DRYER LINT RECEPTACLE

[76] Inventor: Paul S. Barnes, 4720 Holland Dam Dr., Flowery Branch, Ga. 30542

[21] Appl. No.: 738,736

[22] Filed: Oct. 28, 1996

[51] Int. Cl.[6] ..... F26B 19/00

[52] U.S. Cl. ..... 34/235; 34/86; 34/233; 454/367; 454/339

[58] Field of Search ..... 34/82, 86, 233, 34/235, 275; 454/339, 367; 55/497, 505, 506, 429

[56] References Cited

U.S. PATENT DOCUMENTS

| | | | |
|---|---|---|---|
| 3,999,304 | 12/1976 | Doty | 34/86 |
| 4,121,351 | 10/1978 | Kapke | 34/86 |
| 4,183,150 | 1/1980 | Nash | 34/86 |
| 4,227,315 | 10/1980 | Hight | 34/133 |
| 4,334,461 | 6/1982 | Ferguson et al. | 98/119 |
| 4,338,731 | 7/1982 | Shames et al. | 34/82 |
| 4,395,831 | 8/1983 | Nielsen | 34/86 |
| 4,434,564 | 3/1984 | Braggins, Jr. | 34/86 |
| 4,530,170 | 7/1985 | Green | 34/82 |
| 4,967,490 | 11/1990 | Berger | 34/235 |
| 5,210,960 | 5/1993 | LaRue | 34/82 |
| 5,482,507 | 1/1996 | Priest | 454/359 |
| 5,547,422 | 8/1996 | Seboldt | 454/359 |

*Primary Examiner*—Henry A. Bennett
*Assistant Examiner*—D. Doster

[57] ABSTRACT

The present invention is an externally mounted clothes dryer filter which attaches to a standard clothes dryer hose. The externally mounted clothes dryer filter is fastened to an external wall of a structure. The clothes dryer exhaust hose is attached to an input. A screen device in the filter captures lint and other particulate matter. The filter can be removed for cleaning.

5 Claims, 3 Drawing Sheets

CLOTHES DRYER LINT RECEPTACLE

BACKGROUND OF THE INVENTION

1. Field of the Invention

The present invention relates to air filtration. More particularly, the present invention relates to lint filters for a clothes dryers.

2. Description of the Prior Art

Numerous innovations for Clothes Dryer Lint Receptacle have been provided in the prior art that are described as follows. Even though these innovations may be suitable for the specific individual purposes to which they address, they differ from the present invention as hereinafter contrasted.

In U.S. Pat. No. 5,482,507 titled Clothes Dryer Vent, invented by Johnny Priest, a vent structure that acts as a combination masonry guide and lintel. The flat interior portion has flanged sides and a bottom disposed perpendicular to the interior plate so a vent pipe can pass therethrough. The upper flange is the same size as a masonry lintel and is longer than and overhangs the side flanges. The structure is preferably integrally formed from plastic or metal. An exterior protective closure is mounted on the masonry guide once the building structure has been completed. The closure mounts on the vent pipe and will open when air or other fluids are passing from the vent pipe and will automatically close when the flow ceases.

The patented invention differs from the present invention because the patented invention does not have a filter means. In U.S. Pat. No. 5,210,960, titled Lint Filter, invented by Len LaRue, a lint filter having a container provided with a drawer. A fitting is associated with the container for connecting a hose from a clothes dryer and the like to the container while at least one aperture is provided adjacent the fitting for permitting air carrying the lint into the container to escape therefrom, a baffle is disposed within the container in order to form a flow path for the air lint through a filter causing the lint to adhere thereto. A rotating filter and a stationary wiper blade are means for cleaning the filter.

The patented invention differs from the present invention because the patented invention has a rotating filter and a wiper blade which scrapes the deposited lint from the filter. The removed lint simply drops to the bottom of the device where it remains until removed. The user must periodically remove deposited lint by rotating the filter a well as emptying the entire box at less frequent interval. The present invention is simpler, having no moving parts and requiting infrequent emptying of up to six months during testing.

In U.S. Pat. No. 4,967,490, titled Dryer Exhaust Vent, invented by Edwin Berger and Francis Sass, a dryer exhaust vent having a rectangular body bounding an air passage for the exiting moisture laden air from the dryer, in which multiple vanes for blocking reverse flow through the vent are pivotally mounted in the body opening which opens into the air passage so that the vanes pivotally traverse within the protective confines of the body and are not adversely effected by the weather, vandalism or the like.

The patented invention differs from the present invention because the patented invention is self closing aperture which opens under exhaust pressure. No filtering of the exhaust gas is provided.

In U.S. Pat. No. 4,530,170, titled Insulated Vent Adaptor, invented by Morris J. Green, a vent adaptor is disclosed which is suitable for attaching to the end of a dryer vent to connect the dryer vent to the building exterior through an existing wall opening. The vent adaptor includes a T-shaped hollow fitting which is fabricated with a vertical connector leg attachable to the end of the dryer vent and an intercommunicating hollow, horizontal conduit. The horizontal conduit includes a forward, insulating branch which forwardly terminates in a transition piece for frictional engagement within the building wall and a horizontally juxtaposed, rearwardly positioned storage branch in communication therewith. An insulating plug is reciprocal within the conduit from a storage position within the storage branch to an insulating position within the building opening whereby the building opening can be plugged when the dryer is not in use. A filter is removably secured in the storage branch interiorly of the storage plug in such a manner that warm, moist air from the dryer may be directed interiorly of the building through the filter when the insulating plug is reciprocated to its insulating position within the building wall opening.

The patented invention differs from the present invention because the patented invention is a valve and filter combined to permit exhaust gas to be filtered and vented into a building during cold weather ans exhausted outside during hot weather. The exhaust gas is not filtered. The present invention filters the exhaust gas and does not permit exhausting the gas into the building.

In U.S. Pat. No. 4,434,564, titled Heat Recovery System for Clothes Dryers and the Like, invented by John C. Braggins, a heat recovery device is adapted for placement in the heat exhaust vent pipe of a conventional clothes dryer. The device includes a scrubber for primary removal of lint from the dryer exhaust and a final filter means for removing small particles of lint remaining prior to allowing the warm, humid dryer exhaust air to pass into the atmosphere of the interior environment of a home. The scrubber includes a series of ducts opening into an enlarged plenum and a baffle plate in the plenum to inhibit streamlined flow of air allowing the lint to settle to the bottom of the plenum and the final filter includes a series of expanded aluminum screens or mesh for positively prohibiting passage of lint into the atmosphere. A clean-out tray is provided at the bottom of the plenum to facilitate removal of lint from the plenum for disposal. The device also includes a bypass duct for passing the dryer exhaust air through the device and to the outside of the home and valve for selectively directing the flow of air through the scrubber or through the bypass duct as desired.

The patented invention differs from the present invention because the patented invention is a valve and filter combined to permit exhaust gas to be filtered and vented into a building during cold weather and is exhausted outside during hot weather. The exhaust gases is not filtered. The present invention filters the exhaust gas and does not permit exhausting the gas into the building.

In U.S. Pat. No. 4,395,831, titled Dryer Vent, invented by Edward G. Nielsen, a vent apparatus for controlling the flow of heated exhaust air from a clothes dryer has a housing connected to the heated exhaust conduit and a filter within the housing for filtering the exhaust gases. Controls regulate the relative mounts of exhaust gases directed outside the dryer room and through the housing into the dryer room. In one embodiment, the heated dryer air is ducked through the housing and the control is a valve which directs the gas either into the housing or through the exhaust outlet of the housing. The invention channels moist, heated air into a house in desired proportions to conserve heat energy and to humidify the home in the winter.

The patented invention differs from the present invention because the patented invention is a valve and filter combined to permit exhaust gas to be filtered and vented into a building during cold weather and is exhausted outside during hot weather. The exhaust gases is not filtered. The present invention filters the exhaust gas and does not permit exhausting the gas into the building.

In U.S. Pat. No. 4,338,731, titled Vent for a Clothes Dryer, invented by Sidney J. Shames, and Harold Shames, an energy saving vent is provided for selectively directing hot, moist exhaust air from a clothes dryer either through a downstream vent sleeve to the outdoors, or through a vent port to the indoors. The vent includes four major components principally molded from a synthetic plastic resin, the components being: an open sided housing; a closure panel for closing one open side of the housing; a valve member within the housing for selectively directing air through the housing in alternate paths; and a filter screen assembly for another open side of the housing. The selectively swingable valve carried a pressure relief means adapted to provide for passage therepast of pressurized exhaust gas when the valve is in its position to direct air flow indoors, and in the event that the flow of air indoors is blocked by the filter screen being clogged. The preferred filter screen is a truncated, basket-like, member that is carded on a frame which is removably carried in a slide channel defined on the housing. The valve member is formed integral with an elongated pivot shaft. Opposed portions of the housing are formed to provide bearings within which the valve's pivot shaft is selectively pivotable, and axial slidable. Means are provided for latching the valve in each of its alternate positions.

The patented invention differs from the present invention because the patented invention is a valve and filter combined to permit exhaust gas to be filtered and vented into a building during cold weather and is exhausted outside during hot weather. The exhaust gases are not filtered. Further, the device has provisions to automatically exhaust gasses when the filter is dogged. The present invention filters the exhaust gas and does not permit exhausting the gas into the building.

In U.S. Pat. No. 4,334,461, titled Portable Window Dryer Vent, invented by Arthur Ferguson and George Spector, a portable window vent screen hat includes a large hole therethrough with a ventilator adjacent its outer side bolted to an adapter on its inner side, and a flexible hose from a gas or electric dryer being detachably attachable to the adapter whenever the dryer is used, so as to move humid air from the dryer outwardly of the house.

The patented invention differs from the present invention because the patented invention device to adapt a window opening to a dryer exhaust hose permitting the window to exhaust gas which keeping gas from returning into the building. The present invention filters the exhaust gas and does not permit exhausting the gas into the building. It functions with a aperture through a structure wall and a dryer exhaust hose passing therethrough.

In U.S. Pat. No. 4,227,315, titled Clothes Dryer Heat Economizer, invented by Jesse G. Hight, a filter unit for use with a clothes dryer for filtering the exhaust and selectively directing the exhaust to the outside or inside of a building. The filter unit supports a filter element in a slanted position so that when installed between the studdings of a building the filter unit does not extend an appreciable amount beyond the surface of the wall and still provides for large capacity filtering. A removable cover makes for easy access to the filter element. The filter housing is made of sheet material which has reinforced walls. An indicator is used for indicating the condition of the filter element.

The patented invention differs from the present invention because the patented invention is a valve and filter combined to permit exhaust gas to be filtered and vented into a building during cold weather and is exhausted outside during hot weather. The exhaust gases are also filtered. Further, the patented invention has a indicator that visibly indicates when the filter needs changing. The present invention filters the exhaust gas and does not permit exhausting the gas into the building. It functions with a aperture through a structure wall and a dryer exhaust hose passing therethrough. The filter of the present invention is visible so that the condition can be easily monitored with out an indicator.

In U.S. Pat. No. 4,183,150, titled Electric Clothes Dryer Heater, invented by Robert B. Nash, an apparatus for utilizing the heat and humidity from an electric clothes dryer to heat and humidify an enclosure consists of a container having two openings, one entrance opening communicating with one end of a flexible conduit, the other end of the flexible conduit being capable of attaching to the exhaust outlet of an electric clothes dryer, the second exit opening, having a filter attached thereto, communicating with the enclosure atmosphere.

The patented invention differs from the present invention because the patented invention is internal filter which permits exhaust gas to be filtered and vented into a building. The patented invention does not exhaust gas outside the building. The patented invention is free standing and it not supported by a wall. The present invention filters the exhaust gas and does not permit exhausting the gas into the building. It functions with a aperture through a structure wall and a dryer exhaust hose passing therethrough. The filter of the present invention is visible so that the condition can be easily monitored with out an indicator.

In U.S. Pat. No. 3,999,304, titled Clothes Dryer Filter and Exhaust System, invented by Edward E. Doty, a portable filter enclosure is connected to the exhaust outlet for a clothes dryer. The enclosure includes a multiple stage successive filter screen arrangement for removing entrained particles or lint from the air stream from the dryer. The enclosure is coupled through a flexible coupling to the exhaust outlet of the dryer to permit the exhausted heat to be directed at will to any part of the room or rooms near the dryer. Further included is a louvered arrangement in the outlet of the enclosure which permits further adjustment of the air stream. The outlet of the enclosure has a shape which is adapted to allow for connection of a hand-held drying tool or the like which may then be connected to utilize the output of the warm air from the dryer.

The patented invention differs from the present invention because the patented invention is an internal filter which permits exhaust gas to be filtered and vented into a building. The patented invention does not exhaust gas outside the building. The patented invention includes a air direction means to point air in a desired direction. The present invention filters the exhaust gas and does not permit exhausting the gas into the building. It functions with a aperture through a structure wall and a dryer exhaust hose passing therethrough.

In U.S. Pat. No. 4,121,351, titled Vent Apparatus for Clothes Dryer, invented by Dwight L. Kapke, a vent apparatus for a clothes dryer is disclosed comprising a tube having an outlet and an inlet opening. A removable screen is positioned across the outlet opening for filtering lint particles from the exhaust stream of a forced air clothes drying apparatus.

The patented invention differs from the present invention because the patented invention is a valve and filter combined to permit exhaust gas to be filtered and vented into a building during cold weather and is exhausted outside during hot weather. Further, the patented invention has a swiveling head for directing air flow with in the building. The present invention filters the exhaust gas and does not permit exhausting the gas into the building. It functions with a aperture through a structure wall and a dryer exhaust hose passing therethrough. The filter of the present invention is visible so that the condition can be easily monitored.

Numerous innovations for Clothes Dryer Lint Receptacle have been provided in the prior art that are adapted to be used. Even though these innovations may be suitable for the specific individual purposes to which they address, they would not be suitable for the purposes of the present invention as heretofore described.

SUMMARY OF THE INVENTION

A problem encountered with the use of the conventional clothes dryer is the disposal of lint separated from the clothes during the drying process. Most dryer have an internal lint filter, however, usage has shown that they do not trap all of the lint and a considerable mount will bypass the internal filter an be blown out the exhaust hose. If some means is not provided, the lint will be deposited outside in an unsightly manner. Filter exist in the prior art that cause the exhaust gases to pass through a fluid which traps the lint. However, this filter requires frequent cleaning and cannot be used outside in cold climates with out antifreeze. Further, the filter clog frequently requiring cleaning. The fluid in the container, further causes back pressure which prevent free flow of exhaust gasses.

The present invention solved a long felt need to capture lint which bypasses the internal filter of the dryer and exhausts lint to the area surrounding an external dryer exhaust.

Accordingly, it is an object of the present invention to provide a filter that attaches to the external aperture of a standard dryer hose and captures exhausted lint.

More particularly, it is an object of the present invention to provide a filter which is sized to permit operation for up to six months with out cleaning.

In keeping with these objects, and with others which will become apparent hereinafter, one feature of the present invention resides, briefly stated, in filter retainer that is securely fastened to the output end of a standard dryer hose and the outside wall of a structure.

When the clothes dryer externally mounted lint catcher is designed in accordance with the present invention, all the lint bypassing the internal filter of a dryer is capture in a filter that is maintenance free for up to six months under normal usage.

In accordance with another feature of the present invention, the filter screen is easily removed for cleaning.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

10—clothes dryer externally mounted lint catcher (10)
12—filter retainer (12)
12A—front (12A)
12B—top (12B)
12C—back (12C)
12D—hose adapter (12D)
12EL—left end (12EL)
12ELA—left end tab (12ELA)
12ELAA—left tab aperture (12ELAA)
12ER—right end (12ER)
12ERA—right end tab (12ERA)
12ERAA—right tab aperture (12ERAA)
12FL—left vertical member (12FL)
12GL—left horizontal member (12GL)
12HL—left notch (12HL)
12FR—right vertical member (12FR)
12GR—right horizontal member (12GR)
12HR—right notch (12HR)
14—filter (14)
14A—rim (14A)
14AA—rim left end (14AA)
14AAA—rim left end vertical member (14AAA)
14AAB—rim left end notch (14AAB)
14AAC—rim left end horizontal member (14AAC)
14AB—rim front (14AB)
14ABA—rim handle (14ABA)
14AC—rim right end (14AC)
14ACA—rim right end vertical member (14ACA)
14ACB—rim right end notch (14ACB)
14ACC—rim right end horizontal(14ACC)
14AD—rim back (14AD)
14B—screen (14B)
14BA—screen left end (14BA)
14BB—screen front (14BB)
14BC—screen right end (14BC)
14BD—screen back (14BD)
14C—bottom (14C)
14CA—bottom left end (14CA)
14CB—bottom front (14CB)
14CC—bottom right end (14CC)
144CD—bottom back (14CD)
144CE—bottom base (14CE)
16—insertion/removal direction (16)

BRIEF DESCRIPTION OF THE PREFERRED EMBODIMENT

DETAILED DESCRIPTION OF THE PREFERRED EMBODIMENT

Figure 1:
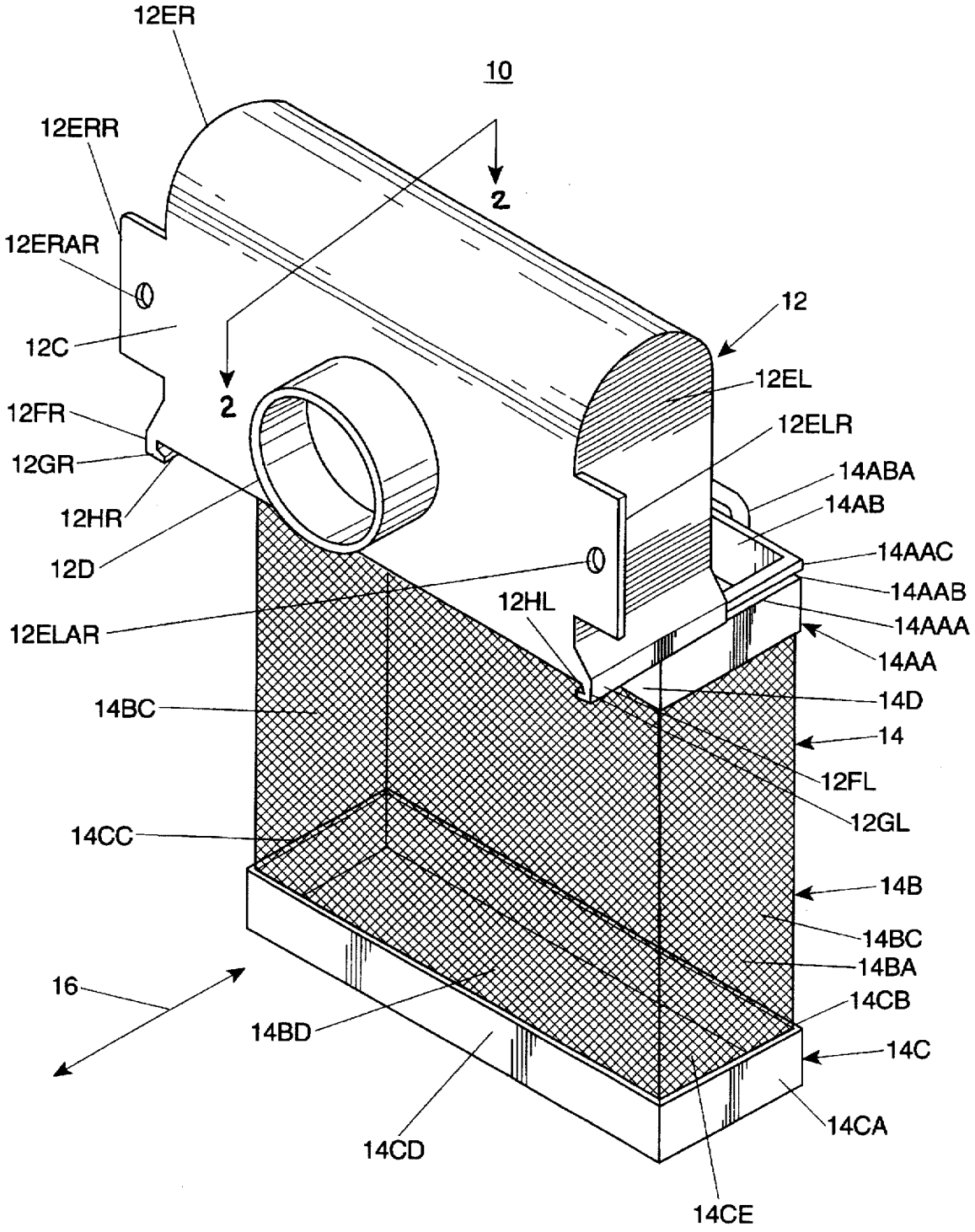
FIG. 1 is a perspective view of a clothes dryer externally mounted lint catcher.

Firstly referring to FIG. 1 which is a perspective view of a clothes dryer externally mounted lint catcher (10) having the following features: filter retainer (12), front (12A), top (12B), back (12C), hose adapter (12D), left end (12EL), left tab (12ELA), left tab aperture (12ELAA), right end (12ER), right tab (12ERA), right tab aperture (12ERAA) left vertical member (12FL), left horizontal member (12GL), left notch (12HL), right vertical member (12FR), right horizontal member (12GR), right notch (12HR), filter (14), rim (14A), rim left end (14AA), rim left end vertical member (14AAA), rim left end notch (14AAB), rim left end horizontal member (14AAC), rim front (14AB), rim right end (14AC), rim right end vertical member (14ACA), rim right end notch (14ACB), rim right end horizontal(14ACC), rim back (14AD), screen (14B), screen left end (14BA), screen front (14BB), screen right end (14BC), bottom (14C), bottom left end (14CA), bottom front (14CB), bottom right end (14CC), bottom back end (14CD), and bottom base (14CE).

A clothes dryer externally mounted lint catcher (10) comprises a filter retainer (12). The filter retainer (12) comprises a front (12A) securely attached at a left distal end to a left end (12EL). The right distal end of the front (12A) is securely attached to a right end (12ER).

The left end (12EL) comprises a left tab (12ELA) securely attached to a back edge. The left tab (12ELA) comprises a left tab aperture (12ELAA) therethrough. The right end (12ER) comprises a right tab (12ERA) securely attached to a back edge. The right tab (12ERA) comprises a right tab aperture (12ERAA) therethrough. The left end (12EL) and right end (12ER) function to fasten the clothes dryer externally mounted lint catcher (10) securely to a structure when a fastening means is inserted through the left tab aperture (12ELAA) and right tab aperture (12ERAA).

The front (12A) is securely attached along a upper distal end to a front distal end of a top (12B). A rear distal end of the top (12B) is securely attached to a back (12C). The back (12C) at a central portion is securely attached to a hose adapter (12D). The hose adapter (12D) function to securely attach a hose, wraped therearound, to the back (12C).

The left end (12EL) further comprises a left vertical member (12FL) securely attached at a lower distal end. The left vertical member (12FL) is securely attached perpendicularly to a left horizontal member (12GL). The left vertical member (12FL) and the left horizontal member (12GL) define a left notch (12HL).

The right end (12ER) further comprises a right vertical member (12FR) securely attached at a lower distal end. The right vertical member (12FR) is securely attached perpendicularly to a right horizontal member (12GR). The right horizontal member (12GR) and the right vertical member (12FR) define a right notch (12HR).

The filter retainer (12) is constructed from materials selected from the group consisting of metal, plastic, wood, plastic composits.

The clothes dryer externally mounted lint catcher (10) further comprises a filter (14). The filter (14) comprises a rim (14A) which is open at a upper distal end. The rim (14A) comprises a rim left end (14AA). The rim left end (14AA) is securely attached at a proximal end to a rim front (14AB). The rim front (14AB) is securely attached at a distal end to a proximal end of a rim right end (14AC). The distal end of the rim right end (14AC) is securely attached to a proximal end of a rim back (14AD). The rim back (14AD) is securely attached at a proximal to the opposite distal end of the rim left end (14AA).

The rim left end (14AA) comprises a rim left end vertical member (14AAA) which is securely attached at one distal edge to an upper distal edge of the rim left end (14AA). The rim left end vertical member (14AAA) is attached at an opposite distal edge to a proximal edge of a rim left end horizontal member (14AAC). The a rim left end horizontal member (14AAC) cooperates with the left notch (12HL) to removably attache the filter (14) to the filter retainer (12) along a left distal edge.

The rim right end (14AC) comprises a rim right end vertical member (14ACA) which is securely attached at one distal edge to an upper distal edge of a rim right end (14AC). The rim right end vertical member (14ACA) is attached at an opposite distal edge to a proximal edge of a rim right end horizontal (14ACC). The rim right end horizontal (14ACC) cooperates with the rim right end notch (14ACB) to removably attache the filter (14) to the filter retainer (12) along a right distal edge. Moving the filter (14) along a insertion/removal direction (16) permits the filter (14) to be removed for cleaning.

The filter (14) further comprises a screen (14B) securely attached to a lower distal rim of the rim (14A). The screen (14B) comprises a screen left end (14BA) which is securely attached along a proximal edge to a distal end of a screen front (14BB). The screen front (14BB) is securely attached along a proximal edge to a distal end of a screen right end (14BC). The screen right end (14BC) is securely attached along a proximal edge to a distal end era screen back (14BD). The opposite distal end of the screen back (14BD) is securely attached to the opposite distal end of the screen left end (14BA). The screen left end (14BA), screen front (14BB), screen right end (14BC), and screen back (14BD) are constructed from a mesh material having apertures sized to capture exhausted material form a clothes dryer and permit free flow of dryer exhaust air. The mesh material is selected from a group consisting of plastic, metal, and fabric.

A bottom (14C) is securely fastened at a lower perimeter of the screen (14B). The bottom (14C) comprises a bottom left end (14CA) securely attached at one distal side to proximal a side of a bottom front (14CB). The distal side of the bottom front (14CB) is securely attached to a proximal side of a bottom right end (14CC). The distal side of the bottom right end (14CC) is securely attached to a proximal side of a bottom back end (14CD). The distal side of the bottom back end (14CD) is securely attached to the opposite distal side of the bottom left end (14CA). The bottom left end (14CA), bottom from (14CB), bottom right end (14CC), and bottom back (14CD) are securely attached at a lower outer perimeter to a upper outer perimeter of a bottom base (14CE). The bottom (14C) functions to close off the bottom of the filter (14) to prevent air and exhausted matter from escaping.

Figure 2:
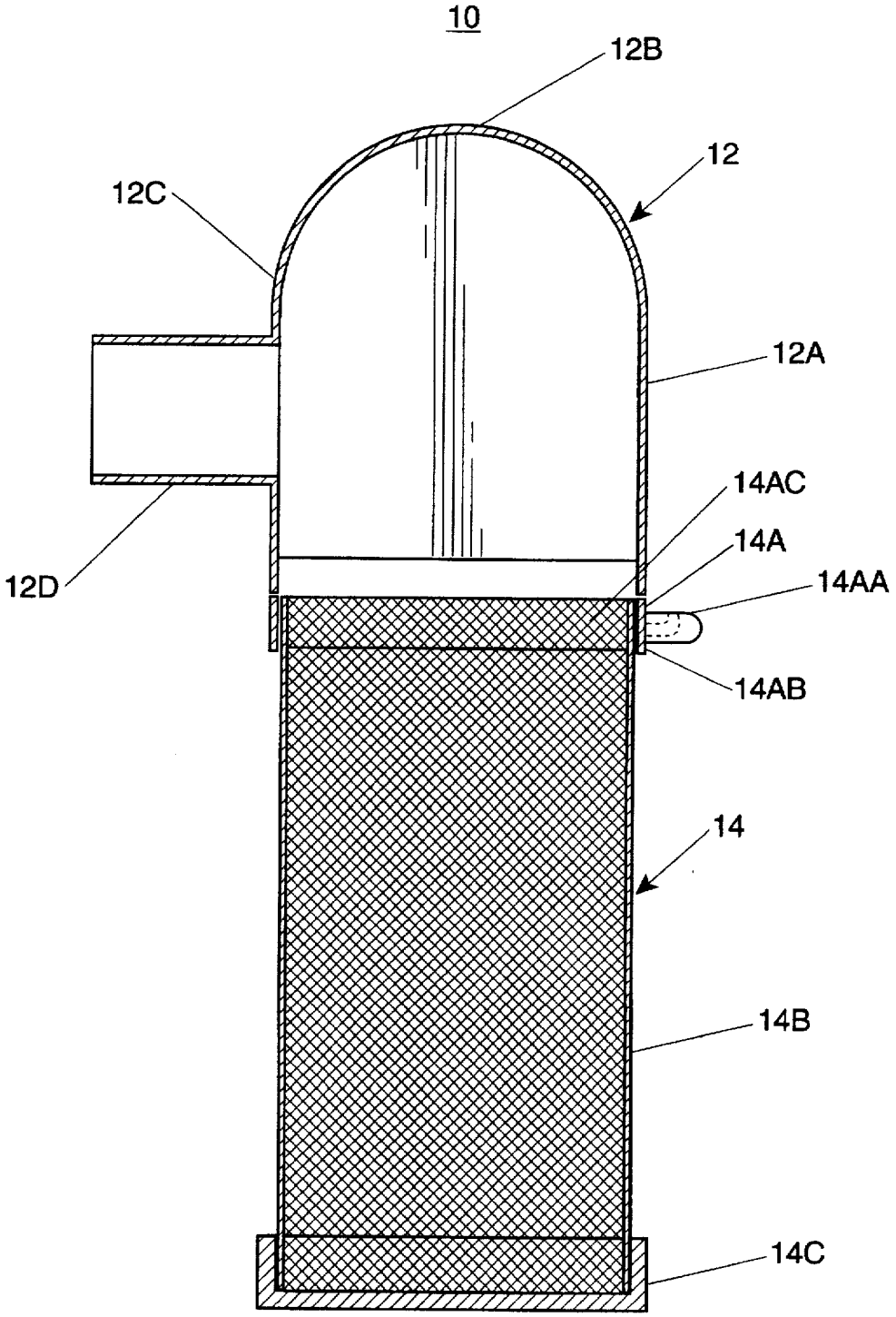
FIG. 2 is a sectional view along lines A—A of FIG. 1 of a clothes dryer externally mounted lint catcher.

Now referring to FIG. 2 which is a sectional view along lines A—A of FIG. 1 of the clothes dryer externally mounted lint catcher (10) having the following features: filter retainer (12), front (12A), top (12B), back (12C), hose adapter (12D), filter (14), rim (14A), rim front (14AB), rim handle (14ABA), rim front (14AB),screen (14B), bottom (14C), and insertion/removal direction (16).

The clothes dryer externally mounted lint catcher (10) comprises the filter retainer (12) having the from (12A). The front (12A) along an upper distal edge is securely attached to a proximal edge of the top (12B). The opposite distal edge of the top (12B) is securely attached to a upper proximal edge of the back (12C). The back (12C) is securely attached to the hose adapter (12D) at a central portion. The hose adapter (12D) is sized to cooperate with standard clothes dryer exhaust hoses.

The rim (14A) comprises the rim front (14AB) having a rim handle (14ABA) securely attached thereto.

The bottom (14C) is securely attached at an outside perimeter to a lower perimeter of screen (14B).

Figure 3:
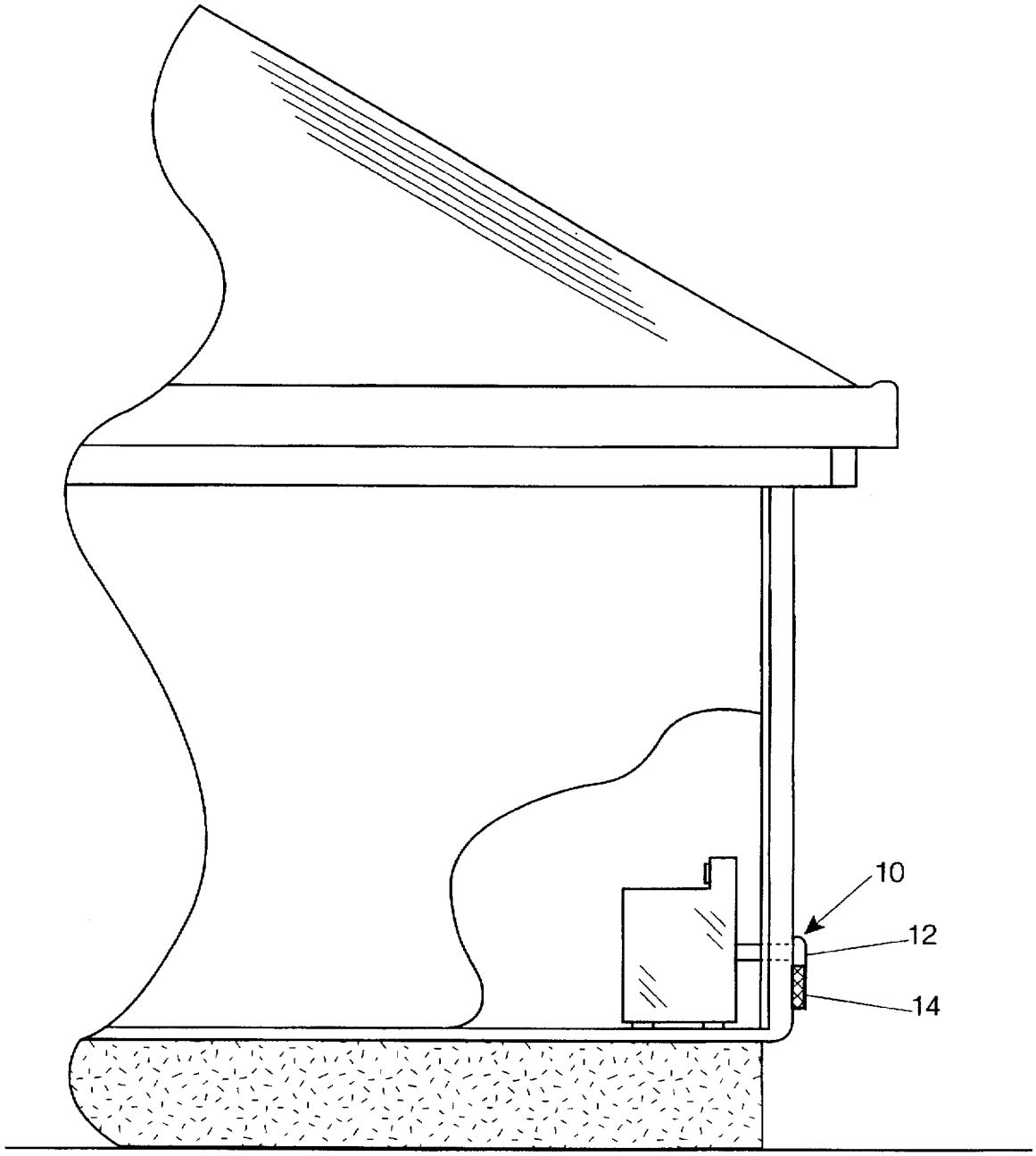
FIG. 3 is a cutaway view of a clothes dryer externally mounted lint catcher.

Lastly, referring to FIG. 3 which is a cut away view of the installed clothes dryer externally mounted lint catcher (10) in a operational position on an external wall of a structure. The filter retainer (12) is securely attached to the structure external wall. The filter (14) at an upper distal end is removably attached to the filter retainer (12) at a lower distal end. The filter (14) is removed for cleaning when the user desires.

It will be understood that each of the elements described above, or two or more together, may also find a useful application in other types of constructions differing from the type described above.

While the invention has been illustrated and described as embodied in a Clothes Dryer Lint Receptacle, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A clothes dryer externally mounted lint catcher (10) comprising:

A) a filter retainer (12) comprises a front (12A), the filter retainer (12) comprises a front (12A) securely attached at a left distal end to a left end (12EL), the right distal end of the front (12A) is securely attached to a right end (12ER), the front (12A) is securely attached along a upper distal end to a front distal end of a top (12B), a rear distal end of the top (12B) is securely attached to a back (12C), the back (12C) at a central portion is securely attached to a hose adapter (12D), the hose adapter (12D) functions to securely attach a standard clothes dryer hose, wrapped therearound, to the back (12C), the filter retainer (12) is securely attached to a vertical structure by a structure attachment means, the filter retainer (12) is constructed from materials selected from the group consisting of metal, plastic, wood, plastic composits, B) a filter (14) is removably attached to the filter retainer (12) by a retainer attachment means, the filter (14) comprises:

i) a rim (14A) which is open at a upper distal end, the rim (14A) comprises a rim left end (14AA), the rim left end (14AA) is securely attached at a proximal end to a rim from (14AB), the rim front (14AB) is securely attached at a distal end to a proximal end of a rim right end (14AC), the distal end of the rim right end (14AC) is securely attached to a proximal end of a rim back (14AD), the rim back (14AD) is securely attached at a proximal to the opposite distal end of the rim left end (14AA), ii) a screen (14B) is securely attached to a lower distal rim of the rim (14A), the screen (14B) comprises a screen left end (14BA) which is securely attached along a proximal edge to a distal end of a screen front (14BB), the screen front (14BB) is securely attached along a proximal edge to a distal end of a screen right end (14BC), the screen right end (14BC) is securely attached along a proximal edge to a distal end of a screen back (14BD), the opposite distal end of the screen back (14BD) is securely attached to the opposite distal end of the screen left end (14BA), the screen left end (14BA), screen front (14BB), screen right end (14BC), and screen back (14BD) are constructed from a mesh material having apertures sized to capture exhausted material form a clothes dryer and permit free flow of dryer exhaust air, iii) a bottom (14C) is securely fastened at a lower perimeter of the screen (14B), the bottom (14C) comprises a bottom left end (14CA) securely attached at one distal side to proximal a side of a bottom front (14CB), the distal side of the bottom from (14CB) is securely attached to a proximal side of a bottom right end (14CC), the distal side of the bottom right end (14CC) is securely attached to a proximal side bottom back end (14CD), the distal side of the bottom back end (14CD) is securely attached to the opposite distal side of the bottom left end (14CA), the bottom left end (14CA), bottom from (14CB), bottom right end (14CC), and bottom back (14CD) are securely attached at a lower outer perimeter to a upper outer perimeter of a bottom base (14CE), the bottom (14C) functions to close off the bottom of the filter (14) to prevent air and exhausted matter from escaping.

2. The clothes dryer externally mounted lint catcher (10) as described in claim 1, wherein the structure attachment means comprises a left tab (12ELA) securely attached to a left back edge of the back (12C), the left tab (12ELA) comprises a left tab aperture (12ELAA) therethrough, the structure attachment means further comprises a right tab (12ERA) securely attached to a back edge of the back (12C), the right tab (12ERA) comprises a right tab aperture (12ERAA) therethrough, the left end (12EL) and right end (12ER) functions to fasten the clothes dryer externally mounted lint catcher (10) securely to a structure when a fastening means is inserted through the left tab aperture (12ELAA) and right tab aperture (12ERAA).

3. The clothes dryer externally mounted lint catcher (10) as described in claim 2, wherein the fastening means is selected from the group consisting of screws, nails, glue, tape, rivets, and tacks.

4. The clothes dryer externally mounted lint catcher (10) as described in claim 1, wherein the retainer attachment means comprises a left vertical member (12FL) securely attached at a lower distal end, the left vertical member (12FL) is securely attached perpendicularly to a left horizontal member (12GL), the left vertical member (12FL) and the left horizontal member (12GL) define a left notch (12HL), the rim left end (14AA) comprises a rim left end vertical member (14AAA) which is securely attached at one distal edge to an upper distal edge of the rim left end (14AA), the rim left end vertical member (14AAA) is attached at an opposite distal edge to a proximal edge of a rim left end horizontal member (14AAC), the retainer attachment means further comprises a right vertical member (12FR) securely attached at a lower distal end, the right vertical member (12FR) is securely attached perpendicularly to a right horizontal member (12GR), the right horizontal member (12GR) and the right vertical member (12FR) define a right notch (12HR), the a rim left end horizontal member (14AAC) cooperates with the left notch (12HL) to removably attache the filter (14) to the filter retainer (12) along a left distal edge, the rim right end (14AC) comprises a rim right end vertical member (14ACA) which is securely attached at one distal edge to an upper distal edge of and right end (14AC), the rim right end vertical member (14ACA) is attached at an opposite distal edge to a proximal edge of a rim right end horizontal (14ACC), the rim right end horizontal (14ACC) cooperates with the rim right end notch (14ACB) to removably attach the filter (14) to the filter retainer (12) along a right distal edge, moving the filter (14) along a insertion/removal direction (16) permits the filter (14) to be removed for cleaning.

5. The clothes dryer externally mounted lint catcher (10) as described in claim 1, wherein the mesh material is selected from a group consisting of plastic, metal, and fabric.

* * * * *